US009702537B2

(12) United States Patent
Wei et al.

(10) Patent No.: US 9,702,537 B2
(45) Date of Patent: Jul. 11, 2017

(54) FLUID COOLED LAMP

(71) Applicant: High Power Lighting Corp., New Taipei (TW)

(72) Inventors: Chih-Hung Wei, New Taipei (TW); Ming-Chang Wu, New Taipei (TW); Jian-Yang Wu, New Taipei (TW); Chih-Yang Hsu, New Taipei (TW); Wun-Ru Liao, New Taipei (TW); Yu-Ting Liu, New Taipei (TW)

(73) Assignee: HIGH POWER LIGHTING CORP., New Taipei (TW)

( * ) Notice: Subject to any disclaimer, the term of this patent is extended or adjusted under 35 U.S.C. 154(b) by 1 day.

(21) Appl. No.: 15/065,381

(22) Filed: Mar. 9, 2016

(65) Prior Publication Data

US 2016/0377277 A1 Dec. 29, 2016

(30) Foreign Application Priority Data

Jun. 24, 2015 (TW) ..... 104120361 A
Jul. 14, 2015 (TW) ..... 104211334 U

(51) Int. Cl.

| | |
|---|---|
| ***F21V 21/00*** | (2006.01) |
| ***F21V 29/51*** | (2015.01) |
| ***F21V 29/503*** | (2015.01) |
| *F21Y 101/02* | (2006.01) |
| *F21Y 103/00* | (2016.01) |

(52) U.S. Cl.

CPC ..... *F21V 29/51* (2015.01); *F21V 29/503* (2015.01); *F21Y 2101/02* (2013.01); *F21Y 2103/003* (2013.01)

(58) Field of Classification Search

USPC ..... 362/249.02

See application file for complete search history.

(56) References Cited

U.S. PATENT DOCUMENTS

2007/0046167 A1* 3/2007 Lantis ..... H01J 5/48 313/311
2008/0239675 A1* 10/2008 Speier ..... H01L 23/13 361/712
2009/0167152 A1* 7/2009 Lee ..... F21K 9/00 313/503
2011/0074296 A1* 3/2011 Shen ..... F21V 3/00 315/112
2011/0155200 A1* 6/2011 Simka ..... H01L 35/30 136/205
2012/0080699 A1* 4/2012 Chowdhury ..... F21V 7/22 257/98

(Continued)

*Primary Examiner* — Tuyen K Vo

(74) *Attorney, Agent, or Firm* — Chun-Ming Shih; HDLS IPR Services

(57) ABSTRACT

A fluid cooled lamp includes: a heat conductive pipe has multiple heat conductive surfaces and a hollow channel; multiple illumination modules arranged at each heat conductive surface; a junction assembly for inlet and outlet of fluid including an inlet joint and an outlet joint, the inlet joint and the outlet joint are respectively communicated with both ends of the hollow channel; a flow guiding inner tube communicated with inlet joint and located in the hollow channel, multiple spray holes are disposed in the flow guiding inner tube, the fluid is sprayed from each spray hole and impacts an inner wall of the heat conductive pipe to remove heat.

14 Claims, 7 Drawing Sheets

(56) References Cited

U.S. PATENT DOCUMENTS

| | | | | |
|---|---|---|---|---|
| 2013/0114263 | A1* | 5/2013 | Peil | F21V 29/02 362/249.04 |
| 2015/0117019 | A1* | 4/2015 | Kuenzler | F21V 7/048 362/294 |
| 2016/0091193 | A1* | 3/2016 | Cai | F21K 9/232 362/235 |
| 2016/0102854 | A1* | 4/2016 | Xiang | F21V 29/006 362/373 |
| 2016/0209020 | A1* | 7/2016 | Sprankle | F21V 29/56 |

* cited by examiner

FLUID COOLED LAMP

BACKGROUND OF THE INVENTION

Field of the Invention

The present disclosure is related to a lamp, in particularly related to a fluid cooled lamp.

Description of the Related Art

Conventional lamps are currently replaced by LED lamps having LED for illumination, and the LED lamp are energy conservative and durable.

However, LED lamps have aforementioned advantages and meanwhile a disadvantage, poor heat dissipation efficiency. Therefore, LEDs are tends to be overheated and broken. Poor heat dissipation efficiency also causes decrease of durability under high temperature operation.

In views of this, in order to solve the above disadvantage, the present inventor studied related technology and provided a reasonable and effective solution in the present disclosure.

SUMMARY OF THE INVENTION

It is an object of the present invention to provide a fluid cooled lamp to improve heat dissipation efficiency of each illumination module in a lamp, and durability of each LED unit is thereby extended.

In order to achieve the aforementioned object, a fluid cooled lamp is provided in the present disclosure. The fluid cooled lamp comprises: a heat conductive pipe having multiple heat conductive surface annularly arranged and a hollow channel among the heat conductive surface; multiple illumination modules arranged at each heat conductive surface to transfer heat to the heat conductive pipe; a junction assembly comprising an inlet joint and an outlet joint, the inlet joint and the outlet joint are respectively communicated with both end of the hollow channel of the heat conductive pipe; a flow guiding inner tube communicated with the inlet joint and located in the heat conductive pipe the hollow channel, multiple spray hole communicated with the outlet joint are disposed in the flow guiding inner tube, each spray hole is arranged toward an inner wall of the heat conductive pipe; and fluid flowing into the inlet joint and flow through the flow guiding inner tube, each spray hole, the heat conductive pipe and the outlet joint, the fluid is sprayed from each spray hole and impacts the inner wall of the heat conductive pipe to remove heat from the heat conductive pipe.

Compared with conventional technology, the present disclosure achieves the following effects: improving heat dissipation efficiency of each illumination module in the lamp, and therefore ensuring durability of the LED unit.

DETAILED DESCRIPTION OF EMBODIMENT

Detail descriptions and technical contacts about the present disclosure are described below with drawings. However, attached drawings are reference used for illustrating the present disclosure, and the present disclosure should not be limited thereby.

Figure 6:
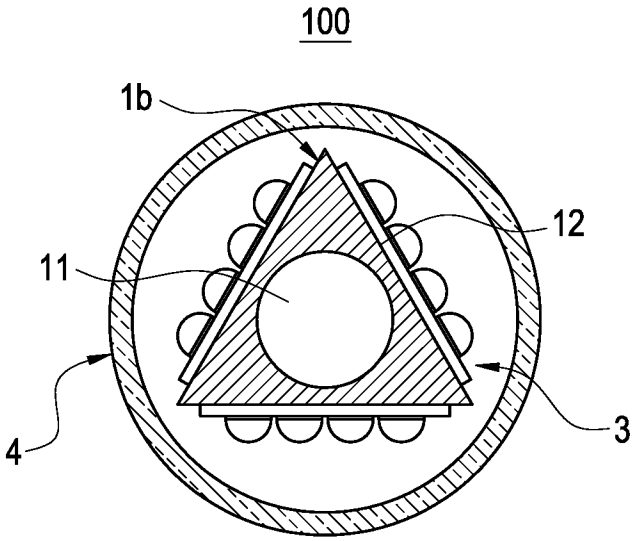
FIG. 6 is a radial sectional view showing another aspect of the lamp with a heat conductive pipe of the first embodiment of the present disclosure.
Figure 5:
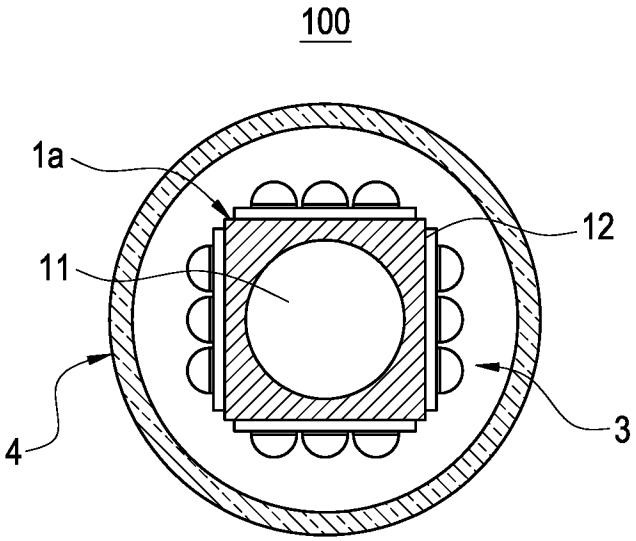
FIG. 5 is a radial sectional view showing an aspect of the lamp with a heat conductive pipe of the first embodiment of the present disclosure.
Figure 7:
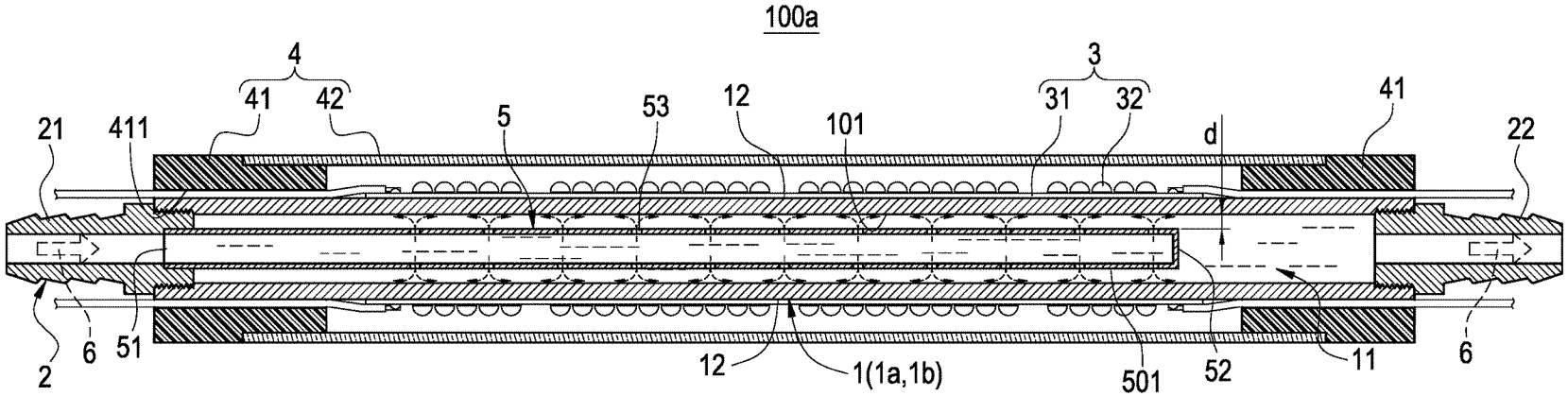
FIG. 7 is a longitudinal sectional view showing the lamp of the second embodiment of the present disclosure.
Figure 8:
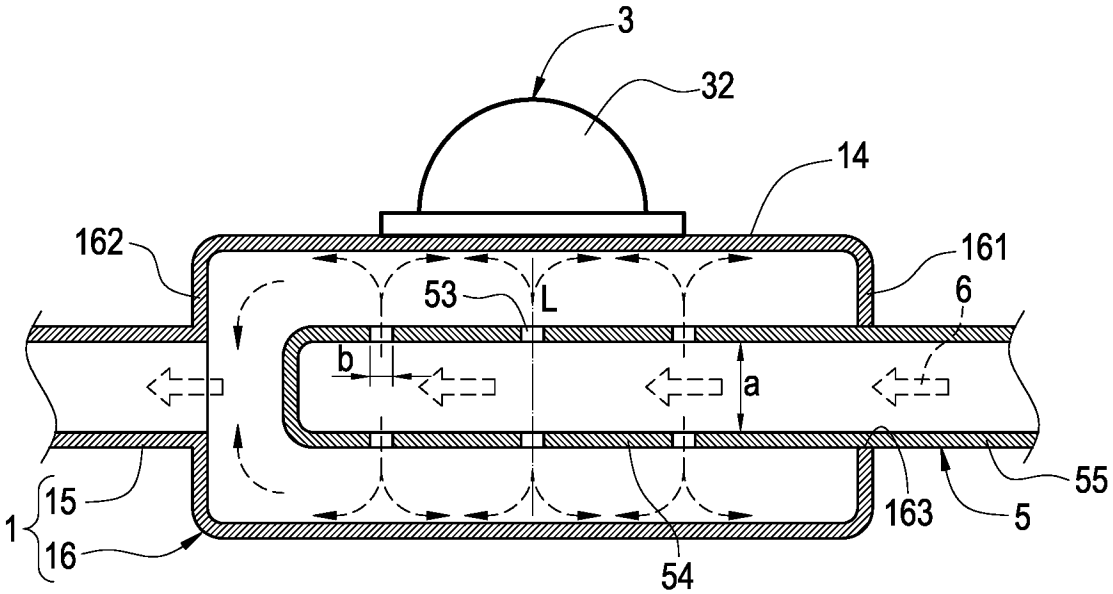
FIG. 8 is a sectional view showing the heat conductive pipe, the illumination module and the flow guiding inner tube of the lamp of the present disclosure.
Figure 9:
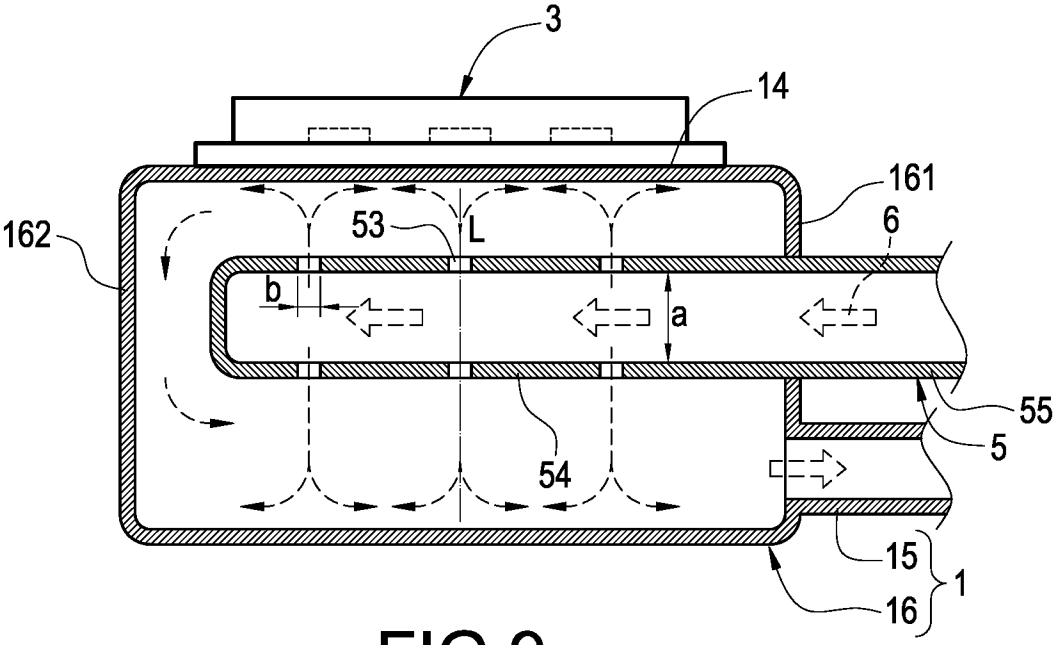
FIG. 9 is another sectional view showing the heat conductive pipe, illumination module and the flow guiding inner tube of the lamp of the present disclosure.

A fluid cooled lamp is provided in the present disclosure. The first embodiment of the present disclosure is shown in FIG. 1-4. FIGS. 5 and 6 are sectional views respectively showing the first embodiment with various heat conductive pipes. FIG. 7 is a sectional view showing the second embodiment of the present disclosure. FIG. 8 is a sectional view showing the heat conductive pipe, the illumination module, and the flow guiding inner tube of the present disclosure. FIG. 9 is another sectional view showing the heat conductive pipe, the illumination module and flow guiding inner tube of the present disclosure.

Figure 1:
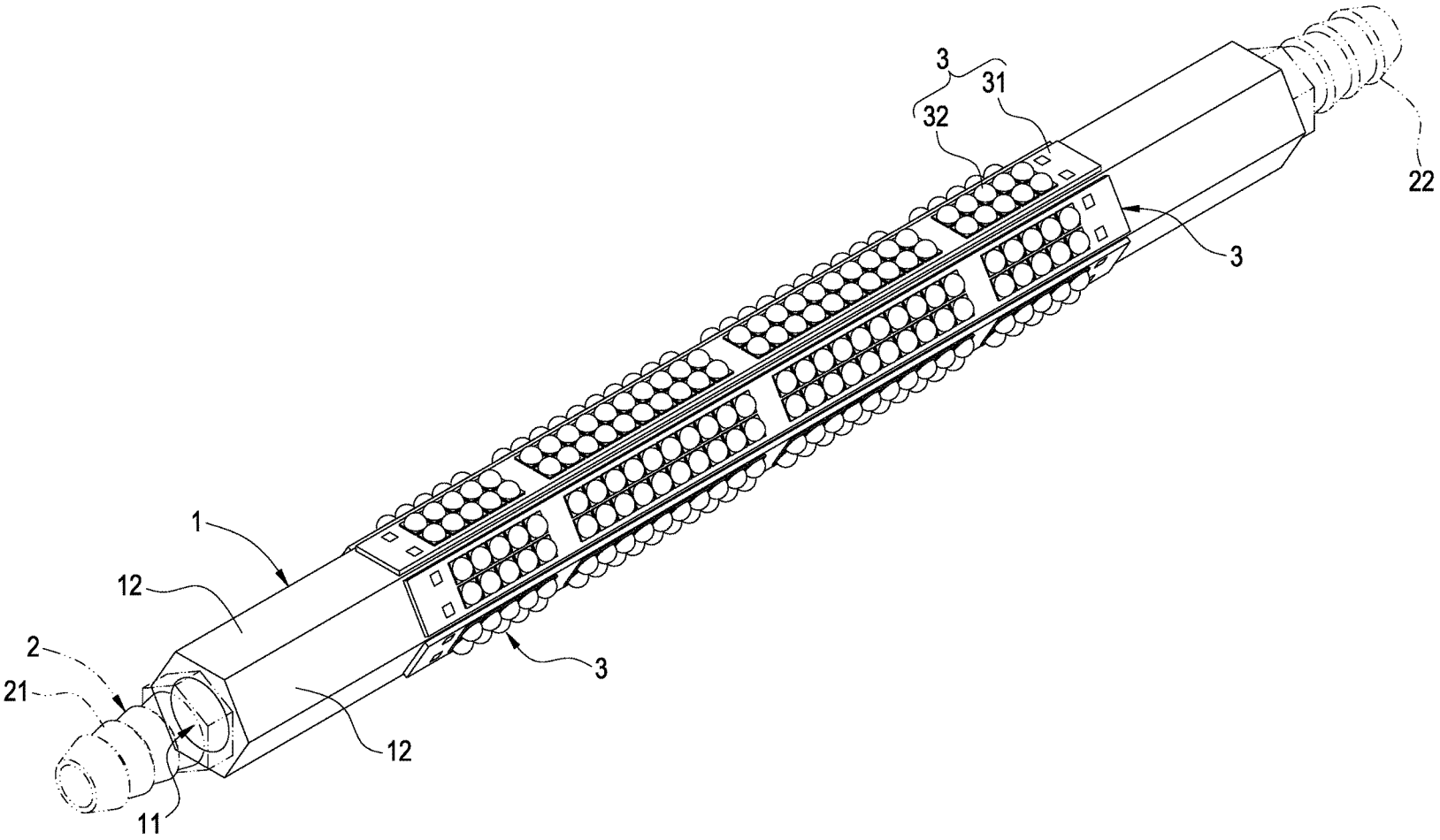
FIG. 1 is a perspective view showing a lamp of the first embodiment of the present disclosure before assembling the optical transmissive cover.
Figure 2:
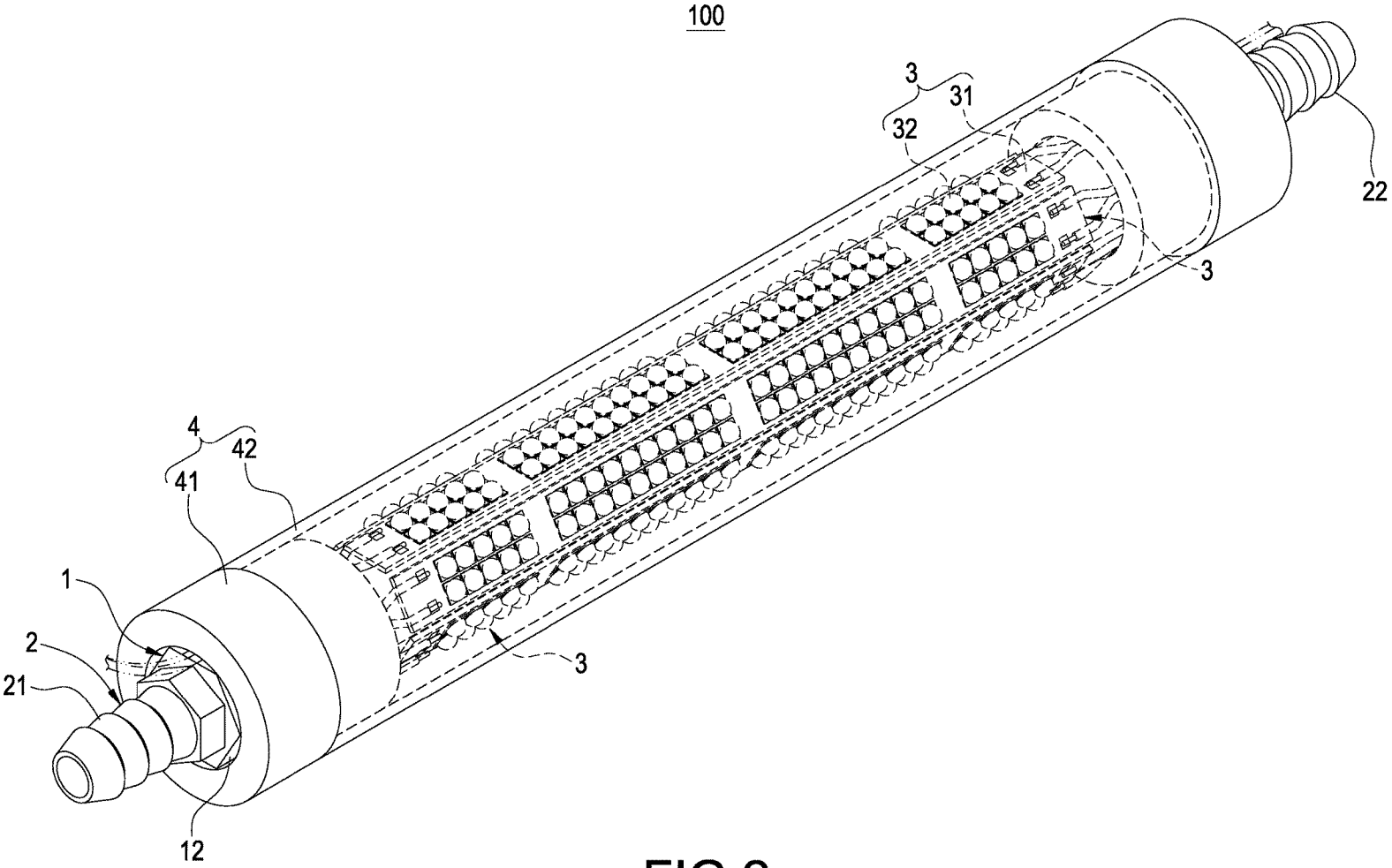
FIG. 2 is a perspective view showing the lamp of the first embodiment of the present disclosure after assembling the optical transmissive cover.
Figure 3:
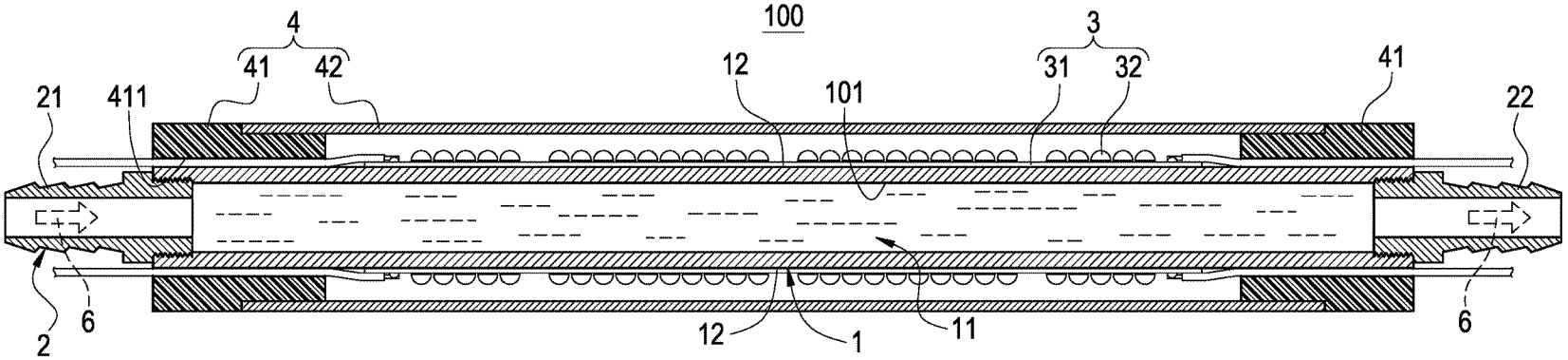
FIG. 3 is a longitudinal sectional view according to FIG. 2 of the present disclosure.
Figure 4:
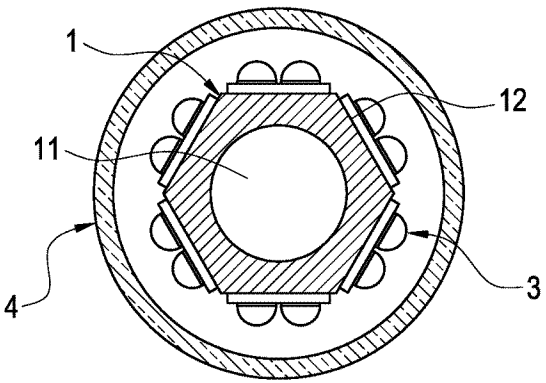
FIG. 4 is a radial sectional view according to FIG. 2 of the present disclosure.

Please refer to FIGS. 1, 2 and 3. A lamp 100 of the first embodiment of the present disclosure comprises a heat conductive pipe 1, a junction assembly 2, multiple illumination modules 3 and a fluid 6, and preferably comprises a optical transmissive cover 4.

The heat conductive pipe 1 is made of heat conductive materials and has multiple heat conductive surfaces 12 and a hollow channel 11 located among the heat conductive surfaces 12. The hollow channel 11 is therefore surrounded by the heat conductive surfaces 12.

The heat conductive pipe 1 could be a polygonal tube, and each heat conductive surface 12 is defined d by each side of the polygonal tube.

The polygonal tube could be a helix tube (refer to heat conductive pipe 1 shown in FIG. 4), rectangle tube (refer to rectangle heat conductive pipe 1*a* shown in FIG. 5) or a triangle tube (refer to triangle heat conductive pipe 1*b* shown in FIG. 6) of the present embodiment, and it is not limited in the present disclosure, The hollow channel 11 should be the polygonal tube, in other words, the polygonal is a tube has three or more lateral surfaces.

Each illumination module 3 is arranged on each heat conductive surface 12, and thereby heat generated by each illumination module 3 could be transferred to the heat conductive pipe 1 through each heat conductive surface 12. It is possible that only an illumination module 3 is arranged on one of the heat conductive surfaces 12, or multiple illumination module 3 are arranged on multiple heat conductive surfaces 12, these are not limitations of the present disclosure.

The illumination module 3 could be a LED unit 32 or an assembly of carrier plate 31 and LED unit 32, and these are not limitations of the present disclosure. A carrier plate 31 and multiple LED units 32 electrically disposed on the carrier plate 31 are described in an example in the present embodiment. The carrier plate 31 is arranged on and contacted with the heat conductive surface 12, and heat generated by the LED unit 32 could be transfer to the heat conductive pipe 1 via the carrier plate 31.

Furthermore, the heat conductive surfaces 12 of the heat conductive pipes 1 (polygonal tube) could be plate surfaces (shown in Figs), curve surfaces, or plate surfaces mixed with curve surfaces (not shown in Fig), and these are not limitations of the present disclosure. Plate heat conductive surfaces 12 are described d in an example in the present embodiment.

The carrier plate 31 of the illumination module 3 on the plate surface heat conductive surface 12 could be a hard printed circuit board or a flexible printed circuit board (not shown in Figs). The carrier plate 31 of the illumination module 3 on the curve heat conductive surface (not shown in Figs) could be a flexible printed circuit board or other printed circuit board (not shown in Figs) which is able to be transformed according to shapes of the curve surface. Accordingly, the carrier plate 31 is contacted with the heat conductive surface 12 is a maximum contact area.

The junction assembly 2 is used for transmission of the fluid 6 in the hollow channel 11 of the heat conductive pipe 1 to remove heat from the heat conductive pipe 1.

The junction assembly 2 comprises an inlet joint 21 and an outlet joint 22. The inlet joint 21 and the outlet joint 22 are respectively connected and communicated with both ends of the hollow channel 11 of the heat conductive pipe 1, and fluid 6 flowing into the inlet joint 21 thereby flows in the hollow channel 11 and contacted with and inner wall 101 of the heat conductive pipe 1 to remove heat from the heat conductive pipe 1 and further outputs via outlet joint 22. Wherein, the heated fluid outputs from the outlet joint 22 will be cooled down and flow back to the inlet joint 21 and further flow into the hollow channel 11. The circulation achieves an object of fluid cooled heat dissipation, heat dissipation efficiency of each illumination module 3 are improved, and durability of LED unit 32 is therefore ensured.

The heat conductive pipe 1 is covered by the optical transmissive cover 4 to prevent each illumination module 3 from moisture, short circuit, or direct impact of external forces.

The optical transmissive cover 4 comprises two end portions 41 and an optical transmissive tube 42 connected between the end portions 41. In the present embodiment, the optical transmissive tube 42 is sleeved on and outer peripheral edge of each end portion 41, but this is not a limitation of the present disclosure. An insertion opening 411 is formed on each of the end portion 41, both ends of the aforementioned heat conductive pipe 1 are respectively inserted in the insertion opening 411 of each end portion 41. Therefore, the illumination module 3 is under protection and lights projected by the illumination module 3 are allowed to project out through the optical transmissive tube 42.

The second embodiment of the present disclosure is shown in FIG. 7. The second embodiment is similar to the aforementioned first embodiment, and a distinction between the embodiments is that the lamp 100*a* of the present embodiment further comprises a flow guiding inner tube 5. The heat conductive pipe 1 of the second embodiment is an undefined polygonal tube, it could be a helix heat conductive pipe 1 shown in FIG. 4, a rectangle heat conductive pipe 1 a shown in FIG. 5 or a triangle heat conductive pipe 1*b* shown in FIG. 6. The heat conductive pipe 1 is marked number 1 to simplify the descriptions.

The flow guiding inner tube 5 has an open end 1*a* close end 52 opposite each other. The open end 51 of the flow guiding inner tube is connected and communicated with the inlet joint 21, and the close end 52 is extended in the heat conductive pipe 1 toward a direction far from the open end 51.

Multiple spray holes 53 are disposed on the flow guiding inner tube 5 between the open end 51 and the close end 52. Each spray hole 53 is communicated with the outlet joint 22, and each spray hole 53 is arranged toward the inner wall 101 of the heat conductive pipe 1.

The fluid 6 flows in to the inlet joint 21, further flows through the flow guiding inner tube 5, each spray hole 53 and the heat conductive pipe 1, and finally outputs from the outlet joint 22.

Wherein, a free end of the flow guiding inner tube 5 is the close end 52, and the fluid 6 filled in the flow guiding inner tube 5 therefore sprays toward the inner wall 101 of the heat conductive pipe 1 via each spray hole 53 while the fluid 6 is inlet into the flow guiding inner tube 5 via the inlet joint 21. The fluid 6 further impacts the inner wall 101 of the heat conductive pipe 1 as a fountain, and multiple spray/fountain contacted areas are thereby formed. Therefore, the fluid 6 flowing in the hollow channel 11 of the heat conductive pipe 1 is slowed down, contact areas and times between the fluid band the heat conductive pipe 1 are increased, and the heat dissipation efficiency thereof is better than the aforementioned first embodiment.

In order to optimize contact times and contact areas between the fluid 6 sprayed from each spray hole 53 and the inner wall 101 of the heat conductive pipe 1, an interval distance (d) should be formed between an outer wall 501 of the flow guiding inner tube 5 and the inner wall 101 of the heat conductive pipe 1.

Furthermore, in the aforementioned embodiments of the present disclosure, one of the heat conductive surfaces 12 of the heat conductive pipe 1, 1*a*, 1*b* could be reserved and empty (not shown in Fig) and no illumination module 3 is disposed thereon. Therefore, the illumination module 3 are arranged on each heat conductive surface 12 excluding the reserved heat conductive surface 12 (not shown in Fig), and unnecessary power consumption is thereby avoided. Because the lamp 100, 100*a* are general settings on a ceiling, illumination toward the ceiling is unnecessary. The reserved heat conductive surface 12 of the heat conductive pipe 1, 1*a*, 1*b* is arranged toward the ceiling (not shown in Fig).

FIG. 8 is a sectional view showing a heat conductive pipe 1, an illumination module 3 and a flow guiding inner tube 5 of the present disclosure. The sectional view detail illustrates how the present disclosure sprays fluid 6 via the spray holes 53 to impact the inner wall 101 of the heat conductive pipe 1, and more detail descriptions are described below.

The heat conductive pipe 1 has a heated segment 14 and a liquid outlet end 15, the illumination module 3 is fixed on and contacted with the heated segment 14. Wherein, the illumination modules 3 could be illumination members such as Halogen lamps or LED units 32, and the illumination modules 3 are the same as the LED unit 32 described below.

The heat conductive pipe 1 has a main body 16, and the main body 16 has a first end 161 and a second end 162 opposite each other. A through opening 163 is formed at the first end 161, the liquid outlet end 15 is outward extended from the second end 162, and the liquid outlet end 15 and the main body 16 are communicated with each other.

The flow guiding inner tube 5 has an insertion segment 54 and a liquid inlet end 55 (the liquid inlet end 55 is formed by the aforementioned open end 51), the insertion segment 54 is inserted in the heat conductive pipe 1, multiple spray holes 53 corresponding to the heated segment 14 are disposed on the insertion segment 54, and a sectional area (a)

of the flow guiding inner tube 5 is larger than a summation of sectional areas (b) of the spray hole 53. Wherein, the liquid outlet end 15 and the liquid inlet end 55 are arranged parallel with each other.

A central line (L) is defined by each spray hole 53, the central line (L) of each spray hole 53 could be arranged perpendicular, parallel, or oblique with the heated segment 14, and the central line (L) of each spray hole 53 is arranged perpendicular with the heated segment 14 in the preferable embodiment.

The fluid 6 flows into the liquid inlet end 55, and further flows through the insertion segment 54, each spray hole 53, the heat conductive pipe 1 and the liquid outlet end 15. Wherein, the fluid 6 could be water, refrigerant or gas.

Therefore, the fluid 6 is guided by the spray hole 53 to initiatively impact the inner wall of the heated segment 14 to rapidly and continually exchange heat between the fluid 6 and the heated segment 14, the fluid 6 is therefore able to rapidly remove heat from the heated segment 14, the fluid 6 is finally output from the liquid outlet end 15 to dissipate heat from the heated segment 14, and heat dissipation efficiency of the present disclosure is therefore improved.

Moreover, an optimal heat exchange efficiency between the a fluid 6 and the heated segment 14 while the central line (L) of each spray hole 53 are arranged perpendicular with the heated segment 14, and an optimal heat dissipation efficiency occurs at the same time. Therefore, heat dissipation efficiency of the present disclosure is improved.

The aforementioned liquid outlet end 15 is not necessarily to be extended from the second end 162, it could also be outward extended from the first end 161 (shown in FIG. 9), and these should not be limitations of the present disclosure. Meanwhile, the liquid outlet end 15 is communicated with the main body 16 (shown in FIG. 9), and the liquid inlet end 55 and the liquid outlet end 15 are parallel with each other.

In summary, the present disclosure has below advantages compared with conventional technology: the heat sources, the illumination module 3, are arranged on each heat conductive surface 12 of the heat conductive pipe 1, 1*a*, 1*b*, the junction assemblies 2 for transferring the fluid 6 to remove heat are connected and communicated with both ends of the heat conductive pipe 1, 1*a*, 1*b*. Therefore, the heat conductive pipe 1, 1*a*, 1*b* could be cooled by liquid h, heat dissipation efficiency thereof is improved, and disabilities of the LED units are ensured.

Furthermore, the present disclosure has another advantage: the flow guiding inner tube 5 is arranged in the heat conductive pipe 1, 1*a*, 1*b*, and multiple spray hole 53 for spraying the fluid 6 toward the inner wall 101 of the heat conductive pipe are disposed on the flow guiding inner tube 5, and the heat dissipation efficiency is further improved.

Although the present disclosure has been described with reference to the foregoing preferred embodiment, it will be understood that the disclosure is not limited to the details thereof. Various equivalent variations and modifications can still occur to those skilled in this art in view of the teachings of the present disclosure. Thus, all such variations and equivalent modifications are also embraced within the scope of the present disclosure as defined in the appended claims.

What is claimed is:

1. A fluid cooled lamp comprising:

a heat conductive pipe having a plurality of heat conductive surfaces arranged annularly and a hollow channel arranged among the plurality of heat conductive surfaces;

a plurality of illumination modules respectively arranged at each heat conductive surface and thereby transfer heat to each heat conductive surface;

a junction assembly comprising an inlet joint and an outlet joint, and the inlet joint and the outlet joint being respectively communicated to both ends of the hollow channel of the heat conductive pipe;

a flow guiding inner tube communicated with the inlet joint and located in the hollow channel of the heat conductive pipe, a plurality of spray holes communicated with the outlet joint being defined on the flow guiding inner tube, each spray hole being arranged toward an inner wall of the heat conductive pipe; and a fluid flowing from the inlet joint and sequentially flowing toward the flow guiding inner tube, each spray hole, the heat conductive pipe, and the outlet joint; the fluid being sprayed from each spray hole and impacting the inner wall of the heat conductive pipe, and thereby removing heat from the heat conductive pipe.

2. The fluid cooled lamp according to claim 1, wherein an interval distance is defined between an outer wall of the flow guiding inner tube and the inner wall of the heat conductive pipe.

3. The fluid cooled lamp according to claim 1, wherein an end of the flow guiding inner tube is connected and communicated with the inlet joint, an opposite end of the flow guiding inner tube is closed, and the spray holes are disposed between the end and the opposite end of the flow guiding inner tube.

4. The fluid cooled lamp according to claim 1, wherein a sectional area of the flow guiding inner tube is larger than a summation of sectional areas of the spray holes.

5. The fluid cooled lamp according to claim 1, wherein a central line is defined by each spray hole, and the central line is perpendicular with the inner wall of the heat conductive pipe.

6. The fluid cooled lamp according to claim 1, wherein the inlet joint and the outlet joint are arranged parallel with each other.

7. The fluid cooled lamp according to claim 1, wherein the fluid is water, refrigerant or gas.

8. The fluid cooled lamp according to claim 1, wherein the illumination module comprises a carrier plate and a plurality of LED unit arranged on the carrier plate.

9. The fluid cooled lamp according to claim 5, wherein the carrier plate of the illumination module is arranged on and contacted with the heat conductive surface of the heat conductive pipe to transmit heat.

10. The fluid cooled lamp according to claim 1, wherein one of the heat conductive surfaces of the heat conductive pipe is reserved and empty, each illumination module is arranged on other heat conductive surfaces of the heat conductive pipe.

11. The fluid cooled lamp according to claim 1, wherein the heat conductive pipe is a polygonal tube, each heat conductive surface is respectively formed on each side of the polygonal tube.

12. The fluid cooled lamp according to claim 1, further comprising an optical transmissive cover, the heat conductive pipe being surrounded by the optical transmissive cover.

13. The fluid cooled lamp according to claim 9, wherein the optical transmissive cover comprises two end portions and an optical transmissive tube connected between the two end portions, an insertion opening is defined on each of the two end portions, both ends of the heat conductive pipe are respectively inserted in the insertion opening of each end portion.

14. The fluid cooled lamp according to claim 1, wherein the heat conductive surfaces are plate surface and/or curve surface.

* * * * *